US007422116B2

(12) United States Patent
Douglas

(10) Patent No.: US 7,422,116 B2
(45) Date of Patent: Sep. 9, 2008

(54) SELF-PROPELLED SCREENING APPARATUS

(75) Inventor: Patrick Joseph Douglas, deceased, late of Castletown (GB); by Mary Kathleen Douglas, legal representative, Castletown (GB)

(73) Assignee: Extec Screens and Crushers Limited, Swadlincote, Derbyshire (GB)

( * ) Notice: Subject to any disclaimer, the term of this patent is extended or adjusted under 35 U.S.C. 154(b) by 0 days.

(21) Appl. No.: 10/363,496

(22) PCT Filed: Aug. 31, 2001

(86) PCT No.: PCT/GB01/03888

§ 371 (c)(1),
(2), (4) Date: Jul. 12, 2004

(87) PCT Pub. No.: WO02/18066

PCT Pub. Date: Mar. 7, 2002

(65) Prior Publication Data

US 2006/0070925 A1 Apr. 6, 2006

(30) Foreign Application Priority Data

Sep. 2, 2000 (GB) ..... 0021584.8

(51) Int. Cl.
*B07B 1/28* (2006.01)

(52) U.S. Cl. ..... 209/421; 171/86; 171/110; 171/141

(58) Field of Classification Search ..... 171/84, 171/86, 100, 110–112, 135, 137, 139, 141, 171/142, 143; 209/420, 421, 935; 241/101.74
See application file for complete search history.

(56) References Cited

U.S. PATENT DOCUMENTS

| | | | | | |
|---|---|---|---|---|---|
| 3,606,957 | A | * | 9/1971 | Fuzzell | 414/713 |
| 4,363,725 | A | * | 12/1982 | Morita et al. | 209/257 |
| 5,160,034 | A | * | 11/1992 | Potter | 209/38 |
| 5,183,160 | A | | 2/1993 | McClain | |
| 5,581,916 | A | * | 12/1996 | Hirose et al. | 37/444 |
| 5,622,322 | A | * | 4/1997 | Tamura et al. | 241/101.74 |
| 5,957,302 | A | * | 9/1999 | Douglas | 209/421 |

(Continued)

FOREIGN PATENT DOCUMENTS

| | | |
|---|---|---|
| EP | 0692580 | 1/1996 |
| WO | WO 96/03225 | 2/1996 |
| WO | WO 97/04183 | 2/1997 |
| WO | WO 9741971 A1 * | 11/1997 |

*Primary Examiner*—Joseph C Rodriguez
(74) *Attorney, Agent, or Firm*—Kirton & McConkie; Evan R. Witt

(57) ABSTRACT

A self-propelled screening apparatus (1) having a chassis (11); a pair of endless tracks (12) supporting the chassis (11); a superstructure (13) rotatably mounted on the chassis (11); a prime mover (19) provided in or on the superstructure (13) and arranged to provide motive power to operate the endless tracks (12) and where the prime mover (19) is rotatable with the superstructure (13); and a screen box (16) mounted on the superstructure (13), also for rotation therewith. The screen box (16) has an input (17) for receiving a supply of bulk material, at least one screen deck for screening the bulk material, and an output for discharging screened material. The prime mover (19) and the screen box (16) are arranged on opposite sides of the rotational axis of the superstructure (13), to provide a stable weight distribution.

20 Claims, 2 Drawing Sheets

U.S. PATENT DOCUMENTS 5,988,937 A * 11/1999 Komoriya et al. ..... 404/90
6,186,338 B1 * 2/2001 Douglas ..... 209/421
6,834,447 B1 * 12/2004 Currey ..... 37/142.5
6,955,311 B2 * 10/2005 Moro et al. ..... 241/101.741

* cited by examiner

SELF-PROPELLED SCREENING APPARATUS

BACKGROUND OF THE INVENTION

This invention relates to a self-propelled screening apparatus which is operative to screen a supply of bulk material into at least one size range of screened material, and to discharge the screened material to a required deposition zone.

Screening apparatus or plants are used to separate out a supply of bulk material into one or more size ranges of screened material, and typically may be used in quarry locations in order to separate crushed stone into different size ranges of e.g. ballast, sand, gravel and the like. They may also be used in land or site clearance work, when the bulk material may be rubble, broken concrete, tree roots and soil.

Some screening apparatus are very large static installations, when intended for long term use at a particular site. Other apparatus are designed to be transportable from site to site, either via a low loader, or as a towed vehicle, and such apparatus therefore has to be designed to be convertible between a transport mode and an operating (screening) mode.

Still further screening apparatus are self-propelled, and which are therefore required to be easily manoeuvrable, for the purposes of loading the apparatus with bulk material at any particular location, and for discharging screened material at a required deposition zone.

BRIEF SUMMARY OF THE INVENTION

The present invention is concerned with a self-propelled screening apparatus, and seeks to provide, by simple means, an apparatus which is very easily manoeuvrable, and yet also is stable, despite the fact that bulk material is being handled, and the necessary screen or screens to handle the bulk material provide substantial mass, and also generate substantial inertia.

According to one aspect of the invention there is provided a self-propelled screening apparatus which comprises:

a chassis;

a pair of endless tracks supporting the chassis;

a superstructure rotatably mounted on the chassis;

a prime mover provided in or on the superstructure and arranged to provide motive power to operate the endless tracks, said prime mover being rotatable with the superstructure; and a screen box mounted on the superstructure, also for rotation therewith, said screen box having an input for receiving a supply of bulk material, at least one screen deck for screening the bulk material, and an output for discharging screened material;

in which the prime mover and the screen box are arranged on opposite sides of the rotational axis of the superstructure, to provide a stable weight distribution.

According to a second aspect of the invention there is provided a self-propelled screening apparatus which comprises:

a chassis;

a pair of endless tracks supporting the chassis;

a superstructure rotatably mounted on the chassis via a slewing ring; and a screen box mounted on the superstructure for rotation therewith, said screen box having an input for receiving a supply of bulk material, at least one screen deck for screening the bulk material, and an output for discharging screened material.

The invention therefore provides an easily manoeuvrable apparatus via the endless tracks, and also by means of the rotational adjustment of the screen box relative to the chassis to suit loading and/or screening requirements.

The superstructure may comprise a housing or canopy in which an engine may be mounted, and which serves as a source of power to operate the endless tracks, and preferably also any driven components of the screen box e.g. a vibrating mechanism. The engine may be an internal combustion engine, or any suitable power source e.g. a hydraulic pump driven by any suitable means.

The screen box may have more than one screen deck, and may have a loading chute at an inboard end (with respect to the rotational axis) and oversized material i.e. material which is too large to pass downwardly through the screening apertures, may pass directly over the top of the upper screen deck to be discharged via an outboard end of the screen box.

If it is required to provide a facility whereby the discharge from the screen box may be adjustable inwardly or outwardly of the rotational axis of the superstructure on which the screen box is mounted i.e. to move the discharge point nearer to, or further from the apparatus, the screen box may be mounted on, or incorporate a telescopically adjustable frame.

The weight distribution of the apparatus is such that the weight of the screen box (and any material being handled) is balanced by other components of the apparatus on the superstructure e.g. the prime mover.

The screen box may carry out screening operations while the apparatus is static, or on the move if required. Also, via the slewing ring, the screen box can take up any required rotational position through 360° about the rotational axis as may be required, and therefore may include discharge of screened material forwardly, or rearwardly of the direction of travel, or transversely thereof e.g. at 90°.

To further provide for flexibility in operation, by enabling additional positional adjustment of the discharge of screened material, the screen box may be adjustably mounted on the superstructure.

The apparatus may have a driver's cab, and from which an operator can control the movement of the apparatus and/or screening operations.

Alternatively, the apparatus may be arranged to be capable of being operated by remote control, e.g. an infra-red control or a radio controlled system, and which might be provided, for example, in the operating cab of a loading vehicle which is being used to load the apparatus with bulk material.

BRIEF DESCRIPTION OF THE SEVERAL VIEWS OF THE DRAWING

A preferred embodiment of self-propelled screening apparatus according to the invention will now be described in detail, by way of example only, with reference to the accompanying drawing, in which.

DETAILED DESCRIPTION OF TITLE INVENTION

Figure 1:
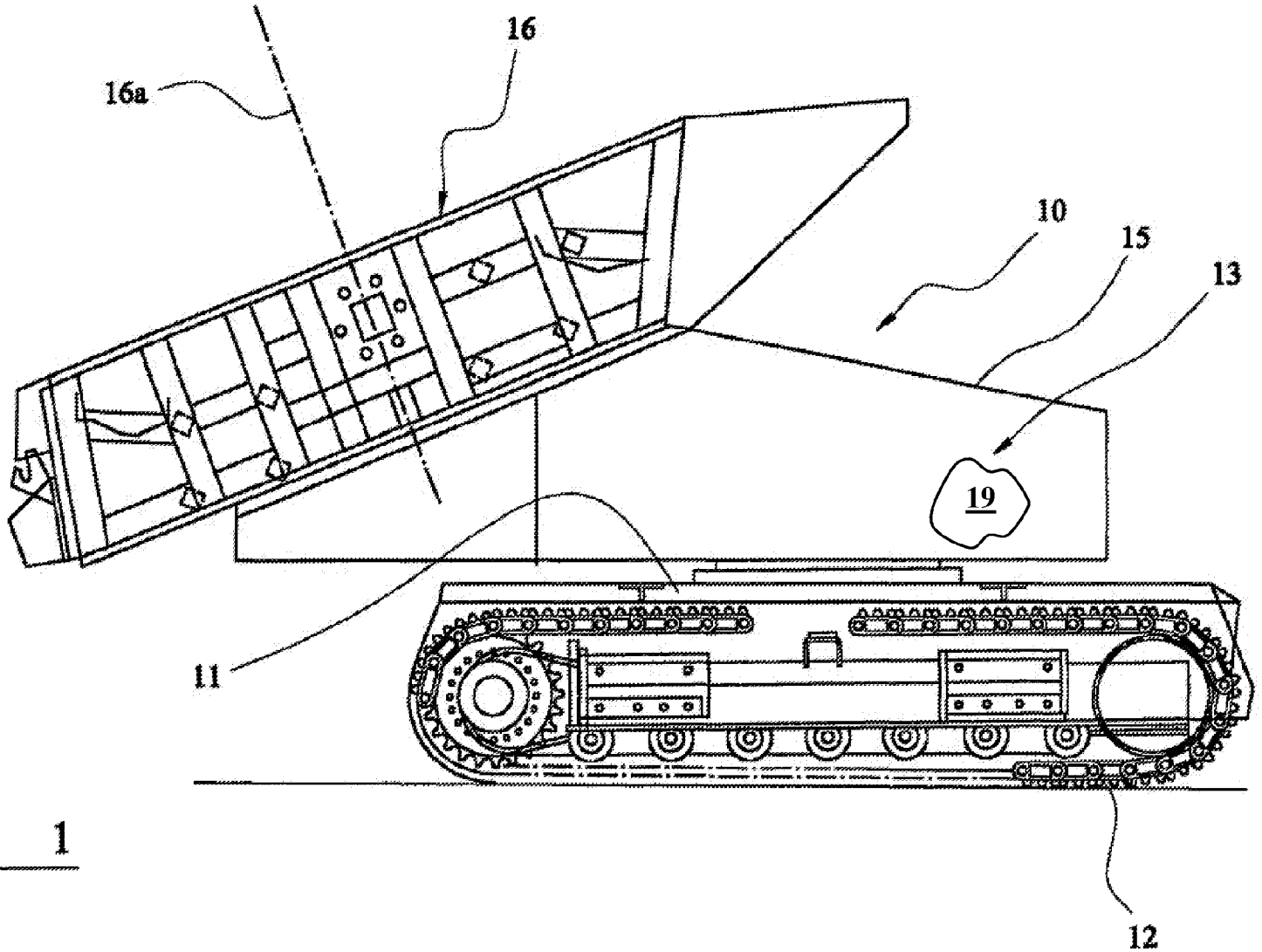
FIG. 1 is a side view of a self-propelled screening apparatus according to the invention, and showing a screen box mounted on one end thereof, and with respect to the longitudinal axis of the apparatus.

Referring now to the drawing, a self-propelled screening apparatus according to the invention is designated generally by reference 10 and which comprises a chassis 11, and a pair of endless tracks 12 which support the chassis 11 and which are driven by any suitable prime mover (not shown) in order to propel the apparatus over the ground. Evidently, by providing endless tracks, selective operation of one or more of the tracks provides easy manoeuvrability of the apparatus, and especially in view of the relatively short length of the tracks, and also the relatively short length of the superstructure mounted on the chassis 11, and as described below.

A superstructure 13 is rotatably mounted on the chassis 11, via a slewing ring 14, whereby the superstructure 13 can be rotated through 360° about a substantially vertical axis passing through the centre of the slewing ring.

The superstructure 13 includes an engine housing or canopy 15 in which a prime mover (19) can be mounted, and which may be an internal combustion engine, or any other suitable power source e.g. a driven hydraulic pump.

Figure 2:
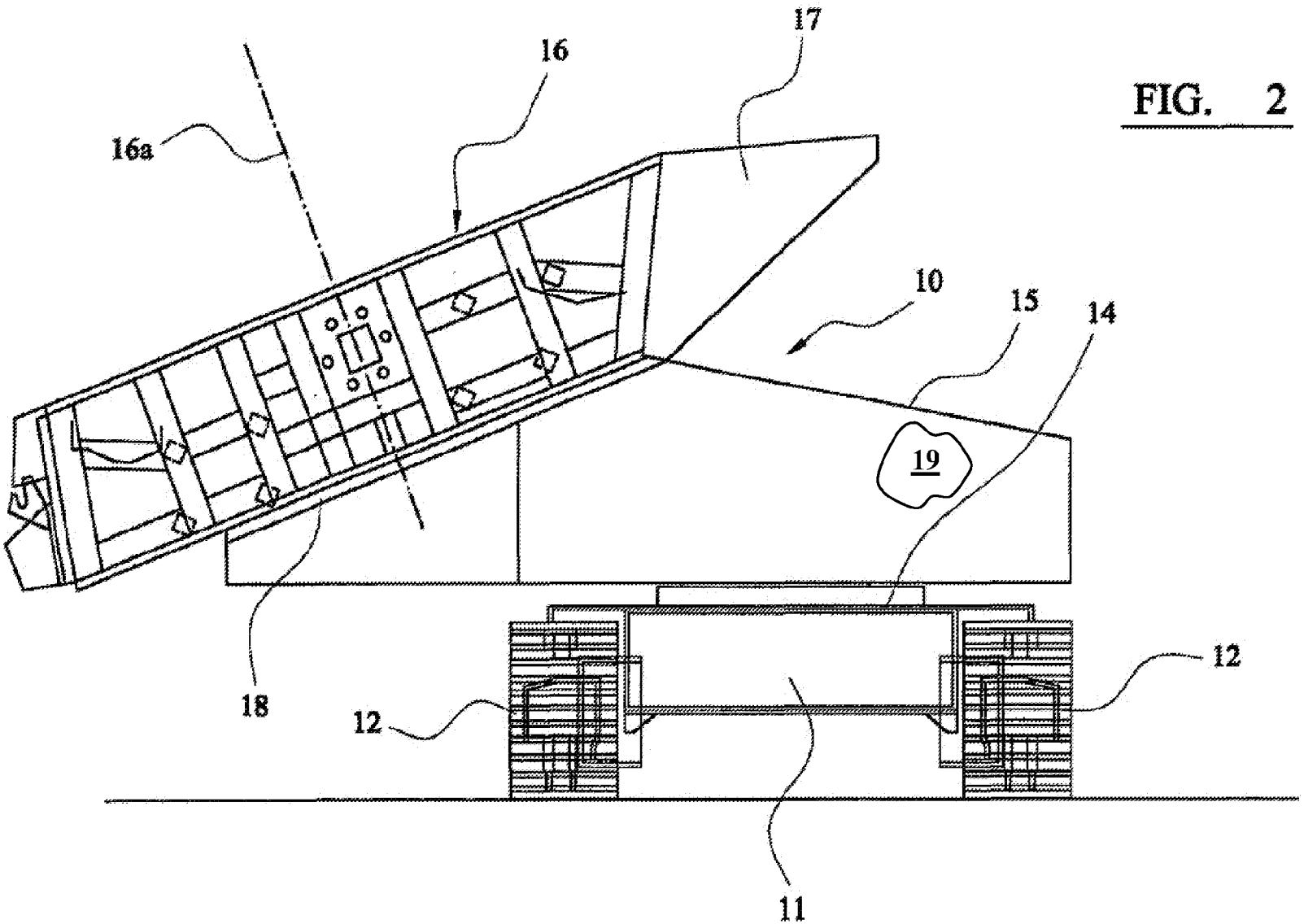
FIG. 2 is an end view, showing the screen box rotated through 90° to a lateral discharge position.

The prime mover 19 provides drive power to operate the endless tracks 12, and also serves to provide drive input (if required) to a screen box 16 which is mounted on the superstructure 13. The screen box 16 is therefore rotatable with the superstructure 13, and can take up an "in-line" position as shown in FIG. 2. Other angular adjustments about the rotational axis can be taken up, according to a required deposition zone for screened material.

If required, additional positional adjustment of the discharge of screened material may be obtained by providing an adjustable mounting of the screen box 16 on the superstructure 13.

Although not shown in detail, the screenbox 16 may be pivotally adjusted about pivot axis 16*a* to alter the deposition point for screened material relative to the superstructure 13, i.e. the screenbox 16 may be independently adjustable relative to the superstructure 13, and which also is adjustable relative to chassis 11 and endless tracks 12.

In a preferred arrangement, the screenbox 16 may be adjustable in either direction through up to 90° from a datum position relative to the superstructure 13.

The screen box 16 has an input in the form of loading chute 17, which receives a supply of bulk material, and at least one screen deck for screening the bulk material, and an output for discharging the screened material. Oversized material i.e. material which is too large to pass downwardly through the screening apertures, may pass directly over the upper screen deck, to be discharged from the outboard end of the screen box 16.

As can be seen in FIG. 1, the screen box 16 is located at one end of the apparatus i.e. is spaced from the rotational axis provided by the slewing ring 14, and therefore to counterbalance this weight, the prime mover 19 is mounted within the housing 15 at the opposite side of the rotational axis. This provides a stable arrangement, during operation.

The prime mover 19, which is mounted in the housing 15, serves as a source of power to operate the endless track 12, and also drive any components of the screen box e.g. a vibrating mechanism, if required.

The screen box 16 may have more than one screen deck, if it is required to screen the bulk material into more than one screened size range.

In order to provide a facility whereby discharge from the screen box may be adjusted inwardly or outwardly of the rotational axis of the superstructure (and therefore also of the screen box), the screen box may be mounted on, or incorporate a telescopically adjustable frame, as shown by reference 18.

The apparatus 10 may include a driver's cab (not shown), from which an operator can control the movement of the apparatus and operation of the screen. Alternatively, the apparatus 10 may be arranged to be operated by remote control e.g. an infra-red or radio control system, or via an umbilical. The remote control conveniently can be exercised by the driver of another vehicle working in conjunction with the screening apparatus e.g. the operator of a loading vehicle delivering supplies of bulk material to the screening apparatus.

The preferred embodiment of the invention therefore provides a simple, but easily manoeuvrable apparatus which can carry out screening operations, and whose position can be adjusted to suit loading requirements and/or discharge requirements of the screened material. There is no need to provide an under-conveyor to work with the screen box, to discharge the screened material. Furthermore, the apparatus can work in any angular position of adjustment about the axis of the slewing ring. The weight distribution of the components mounted on the superstructure is such as to provide a stable operating system.

The invention claimed is:

1. A self-propelled screening apparatus which comprises:

a chassis;

a pair of endless tracks supporting the chassis;

a superstructure comprising a prime mover arranged to provide motive power to operate the endless tracks, said superstructure being rotatable relative to the chassis about a rotational axis extending upwardly from the superstructure; and a screen box mounted on the superstructure, said screen box being pivotally adjustable relative to the superstructure about a pivot axis extending upwardly from the superstructure, said pivot axis of said screen box being additional and independent to the rotational axis by which the superstructure is rotatable relative to the chassis, said screen box being mounted on the superstructure such that the screen box is located directly over at least a portion of the superstructure when oriented with the weight of the apparatus borne by the endless tracks, said screen box having an input for receiving a supply of bulk material, at least one screen deck for screening the bulk material, and an output for discharging screened material;

in which the prime mover is disposed in the superstructure such that the prime mover and the screen box are arranged on opposite sides of the rotational axis of the superstructure, to provide a stable weight distribution, wherein the screen box is mounted on the superstructure to pivot about the pivot axis so that the discharge position of the output of the screen box is adjusted relative to the rotation axis of the superstructure.

2. The apparatus according to claim 1, in which the superstructure comprises a housing or canopy in which the prime mover is mounted.

3. The apparatus according to claim 2, in which the prime mover is arranged to drive driven components of the screen box.

4. The apparatus according to claim 1, in which the screen box has more than one screen deck, and has a loading chute at an inboard end, and an opposite discharge end over which oversized material can be discharged.

5. The apparatus according to claim 1, in which the screen box is adjustable inwardly or outwardly of the rotation axis of the superstructure, to move the discharge point relative to the apparatus.

6. The apparatus according to claim 5, in which the screen box is mounted on, or incorporates a telescopically adjustable frame.

7. The apparatus according to claim 1, and including a driver's cab from which an operator can control the movement of the apparatus and/or screening operation.

8. The apparatus according to claim 1, in which the apparatus is arranged to be capable of being operated by remote control.

9. The apparatus according claim 1, in which the screen box is independently adjustable relative to the superstructure.

10. The apparatus according to claim 1, in which the screen box is pivotable through up to 90 degrees in either direction from a datum position relative to the superstructure.

11. A self-propelled screening apparatus which comprises:

a chassis;

a pair of endless tracks supporting the chassis;

a superstructure rotatably mounted on the chassis via a slewing ring, wherein said superstructure being rotatable relative to the chassis about a rotational axis extending upwardly from the superstructure; and a screen box mounted on the superstructure, said screen box being pivotally adjustable relative to the superstructure about a pivot axis extending upwardly from the superstructure, said pivot axis of said screen box being additional and independent to the rotational axis by which the superstructure is rotatable relative to the chassis, said screen box being mounted on the superstructure such that the screen box is located directly over at least a portion of the superstructure when oriented with the weight of the apparatus borne by the endless tracks, said screen box having an input for receiving a supply of bulk material, at least one screen deck for screening the bulk material, and an output for discharging screened material, wherein the screen box is mounted on the superstructure to be adjustable about the pivot axis so that the discharge position of the output of the screen box is adjusted relative to the rotational axis of the superstructure.

12. The apparatus according to claim 11, in which the superstructure comprises a housing or canopy in which a prime mover is mounted, and which serves as a source of power to operate the endless tracks.

13. The apparatus according claim 12, in which the prime mover is arranged to drive driven components of the screen box.

14. The apparatus according to claim 11, in which the screen box has more than one screen deck, and has a loading chute at an inboard end, and an opposite discharge end over which oversized material can be discharged.

15. The apparatus according to claim 11, in which the screen box is adjustable inwardly or outwardly of the rotational axis of the superstructure, to move the discharge point relative to the apparatus.

16. The apparatus according to claim 15, in which the screen box is mounted on, or incorporates a telescopically adjustable frame.

17. The apparatus according to claim 11, and including a driver's cab from which an operator can control the movement of the apparatus and/or screening operation.

18. The apparatus according to claim 11, in which the apparatus is arranged to be capable of being operated by remote control.

19. The apparatus according to claim 11, in which the screen box is independently adjustable relative to the superstructure.

20. The apparatus according to claim 11, in which the screen box is pivotable through up to 90 degrees in either direction from a datum position relative to the superstructure.

* * * * *